US007117686B2

(12) United States Patent
Jung et al.

(10) Patent No.: US 7,117,686 B2
(45) Date of Patent: Oct. 10, 2006

(54) HIGH-EFFICIENCY TURBULATORS FOR HIGH-STAGE GENERATOR OF ABSORPTION CHILLER/HEATER

(75) Inventors: Sunghan Jung, South Glastonbury, CT (US); Jifeng Zhang, East Hartford, CT (US); Timothy C. Wagner, East Hartford, CT (US); Mark E. Marler, Glastonbury, CT (US); Fabio P. Bertolotti, South Windsor, CT (US); Michael K. Sahm, Avon, CT (US); Jinsang Ryu, Gyunggi-do (KR)

(73) Assignee: UTC Power, LLC, South Windsor, CT (US)

( * ) Notice: Subject to any disclaimer, the term of this patent is extended or adjusted under 35 U.S.C. 154(b) by 377 days.

(21) Appl. No.: 10/733,753

(22) Filed: Dec. 11, 2003

(65) Prior Publication Data

US 2005/0126212 A1 Jun. 16, 2005

(51) Int. Cl.
*F25B 27/00* (2006.01)
*F28F 13/00* (2006.01)

(52) U.S. Cl. ..... 62/238.4; 62/497

(58) Field of Classification Search ..... 62/238.4, 62/476, 497

See application file for complete search history.

(56) References Cited

U.S. PATENT DOCUMENTS 2,359,288 A 10/1944 Brinen
2,691,991 A 10/1954 Schutt
4,352,378 A * 10/1982 Bergmann et al. ..... 138/38
4,899,812 A 2/1990 Altoz
5,738,169 A 4/1998 Stoynoff
5,775,268 A 7/1998 Ferguson
5,901,641 A 5/1999 McNamara
6,056,508 A * 5/2000 Johnson et al. ..... 416/96 R

FOREIGN PATENT DOCUMENTS

DE 19810185 C1 10/1999
EP 1286121 A2 2/2003
EP 1293742 A2 3/2003
GB 2234806 A 2/1991

* cited by examiner

*Primary Examiner*—Melvin Jones
(74) *Attorney, Agent, or Firm*—Carlson, Gaskey & Olds

(57) ABSTRACT

Turbulators are disclosed for use in a high-stage generator for an exhaust-fired absorption chiller/heater. The turbulators are designed to minimize pressure drop across the turbulator, and thus minimize the efficiency loss to the exhaust source. One turbulator design has a number of flanges extending at a non-normal angle to a central web. Further, some of the flanges have cutout portions. The overall turbulator design is intended to minimize wake downstream of the turbulator blades, which could otherwise cause undesirable pressure drop. A second turbulator design incorporates flanges that extend at a normal angle relative to the central web, but wherein the flanges have a non-rectangular cross-sectional shape. Again, the goal of the turbulator designs here is to minimize wake, and potential pressure drop.

11 Claims, 6 Drawing Sheets

HIGH-EFFICIENCY TURBULATORS FOR HIGH-STAGE GENERATOR OF ABSORPTION CHILLER/HEATER

BACKGROUND OF THE INVENTION

This invention relates to turbulators to be utilized in an environment wherein reducing the pressure drop across the turbulator is important. One particularly preferred application is in a high-stage generator for an absorption chiller/heater wherein the heat source is the exhaust of an engine such as a micro-turbine.

Refrigerant absorption cycles have been used for decades to provide a cooled or heated water source for environmental temperature control in buildings. As is known, an absorber and an evaporator in a refrigerant absorption cycle selectively receive a concentrated absorption fluid, such as a LiBr solution, and a separate refrigerant (often water), respectively. The absorption fluid is selectively dropped onto separate tube sets in the absorber and absorbs the refrigerant vapor generated from the evaporator. A dilute solution, containing both the absorption fluid and the refrigerant is then returned to a generator for generating a heated, concentrated absorption fluid. In the generator, a driving heat source drives the refrigerant vapor out of the mixed fluid. From the generator, the absorption fluid and removed refrigerant vapor are separately returned to the absorber and the evaporator, respectively.

The above is an over-simplification of a complex system. However, for purposes of this application, the detail of the system may be as known. Further, while the above-described system provides chilled water, absorption cycles are also utilized to provide heated water for heating of a building. This invention would extend to such systems. For purposes of this application, an absorption chiller and an absorption heater are to be defined generically in the claims as an "absorption solution/refrigerant system" . A worker of ordinary skill in the art would recognize the parallel absorption heater systems and how such systems differ from the disclosed chiller system.

These systems deliver the heated exhaust air to a number of channels known as "smoke tubes" . The smoke tubes are positioned between a number of flow passages that communicate the absorption mixture around the smoke tubes to transfer heat to the absorption fluid.

In the prior art, the turbulators have blades secured to an elongated member. The blades typically have rectangular flanges at a normal angle relative to a central web. The blades provide good heat transfer characteristics. However, in the prior art, the source of heat has been a dedicated source of heat. At times, it may be useful to utilize a source of exhaust heat generated from another separate system to provide the heated fluid. As an example, it may be desirable to utilize the exhaust of a micro-turbine to provide the heat source. The prior art rectangular flanges, in both their shape and arrangement, create a downstream wake region, which increases the pressure drop across the smoke tube. This increase in pressure drop can provide efficiency concerns back upstream to the prime mover (i.e., the micro-turbine). This is undesirable.

SUMMARY OF THE INVENTION

In a disclosed embodiment of this invention, turbulators are proposed to minimize the pressure drop across the smoke tube. Preferably, the turbulator designs are constructed to provide adequate heat transfer characteristics while still minimizing the pressure drop.

In a first embodiment, the turbulator has a central web secured to an elongate connecting member. The central web has flanges extending at a non-normal angle. These flanges minimize wake beyond the turbulator blades, and thus reduce the pressure drop. Further, inward of the outermost flanges are a series of cutout members, and which extend in both directions from the central web. The turbulator blades are placed on alternating sides of the connecting member. The overall arrangement is such that the pressure drop along the turbulator is reduced. Thus, a greater number of blades can be mounted on the turbulator without increasing, or perhaps reducing, the pressure drop when compared to known turbulators. This will then provide better heat transfer characteristics.

In a second embodiment, the flanges may extend at a normal angle relative to the central web, however, they are non-rectangular, and may be in the shape of a triangle. In this manner, the same benefits of reducing wake and thus pressure drop are achieved.

These and other features of the present invention can be best understood from the following specification and drawings, the following of which is a brief description.

DETAILED DESCRIPTION OF THE PREFERRED EMBODIMENT

Figure 1:
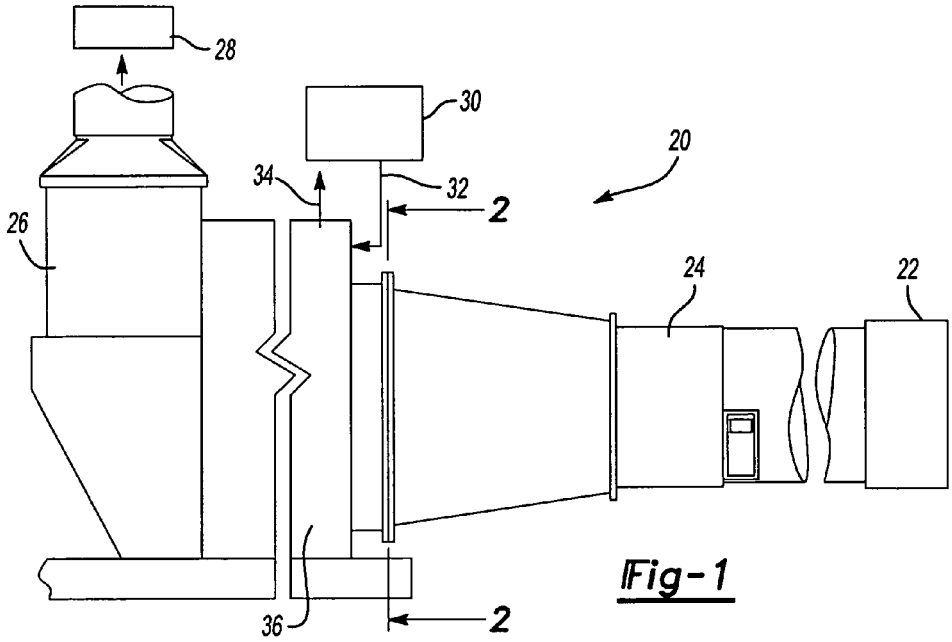
FIG. 1 is a schematic view of an absorption heater/chiller.

FIG. 1 shows an absorption chiller/heater or an "absorption solution/refrigerant system" . In particular high-stage generator 20 receives a source of heat 22. In a preferred embodiment, heat source 22 may be a micro-turbine or some other engine, supplying exhaust air to an inlet duct 24. Inlet duct 24 communicates the heated air to an outlet 26, and from the outlet 26 downstream such as to atmosphere 28.

The absorption chiller/heater incorporates an absorber 30 in which heat is exchanged between an absorption solution and a medium to be heated or cooled. As known, the absorption solution passes through an inlet line 32, communicating to a smoke tube assembly 36. From the smoke tube assembly 36, the absorption solution, and a boiled off refrigerant leave through an exit line 34. The fluid flow details are as known, as shown schematically.

Figure 2A:
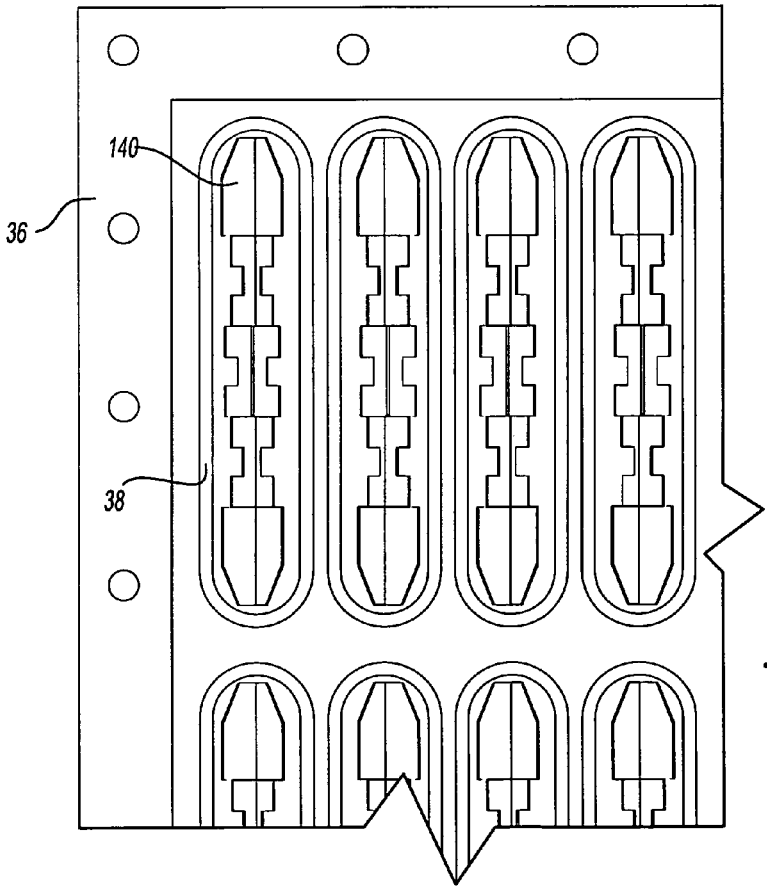
Fig-2A PRIOR ART
FIG. 2A shows a known smoke tube arrangement.

As shown in FIG. 2A, the smoke tube arrangement includes a plurality of channels 38 or smoke tubes, each including a turbulator 140. The exhaust flow from the inlet 24 passes over these turbulators 140. The goal of the turbulators is to create turbulence, and thus increase the heat transfer coefficient of the exhaust air. Though not shown in this figure, it is known in this art that the absorption solution passes through channels arranged around the channels 38, such that heat is transferred from the channels 38 to the absorption solution.

Figure 2B:
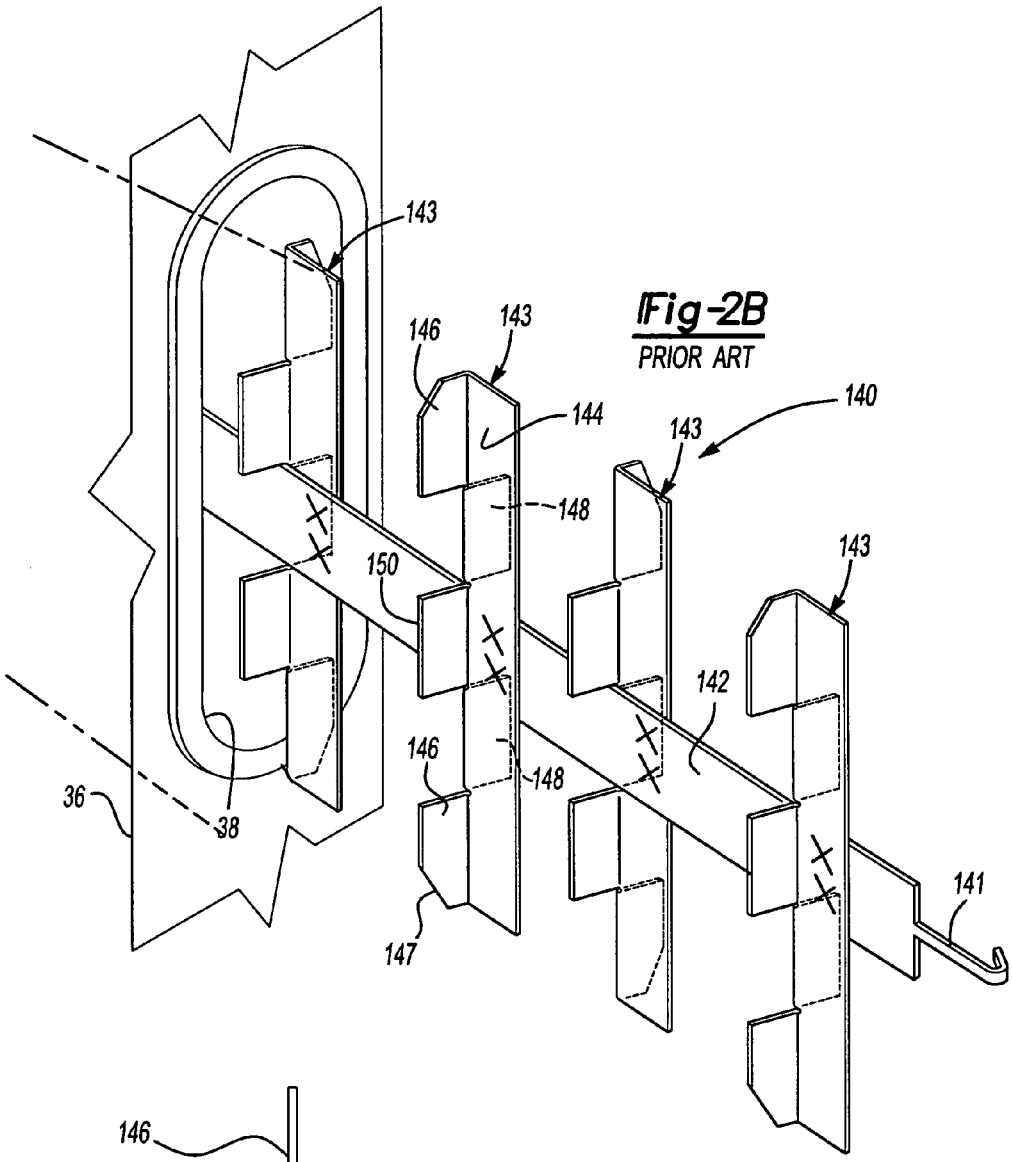
Fig-2B PRIOR ART
FIG. 2B shows a detail of the FIG. 2A arrangement.

FIG. 2B shows a prior art turbulator. As can be appreciated, the prior art turbulator 140 incorporates blades 143 with flanges 146, 148, 150 extending at a perpendicular or normal angle to a central web 144 blades.

Figure 2C:
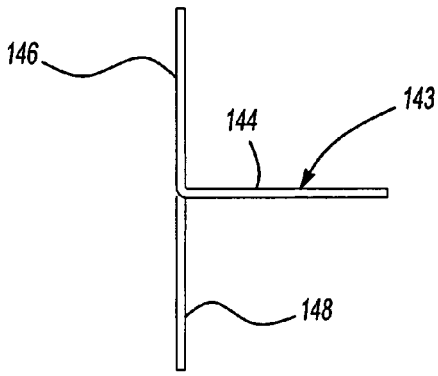
Fig-2C PRIOR ART
FIG. 2C is the side view of the FIG. 2B arrangement.

The blades 143 are secured to a central elongate connecting member 142. A hook member 141 secures the turbulator 140 within the channel 38, as known. The innermost flanges 148 and 150 extend in opposed directions relative to the central web 150, and are normal and rectangular. The outermost flanges 146 are generally rectangular, but have a notch 147 at an outermost edge. As can be seen, alternating blades 143 are mounted on an opposed side of the elongate connecting member 142. While the turbulator 140 as shown in FIGS. 2A–2C does provide good heat transfer characteristics, it also creates wake regions downstream of the blades, and thus an undesirably large pressure drop. FIG. 2C shows the arrangement of the flanges 146, 148 and central web 144 on a blade 143.

Figure 3:
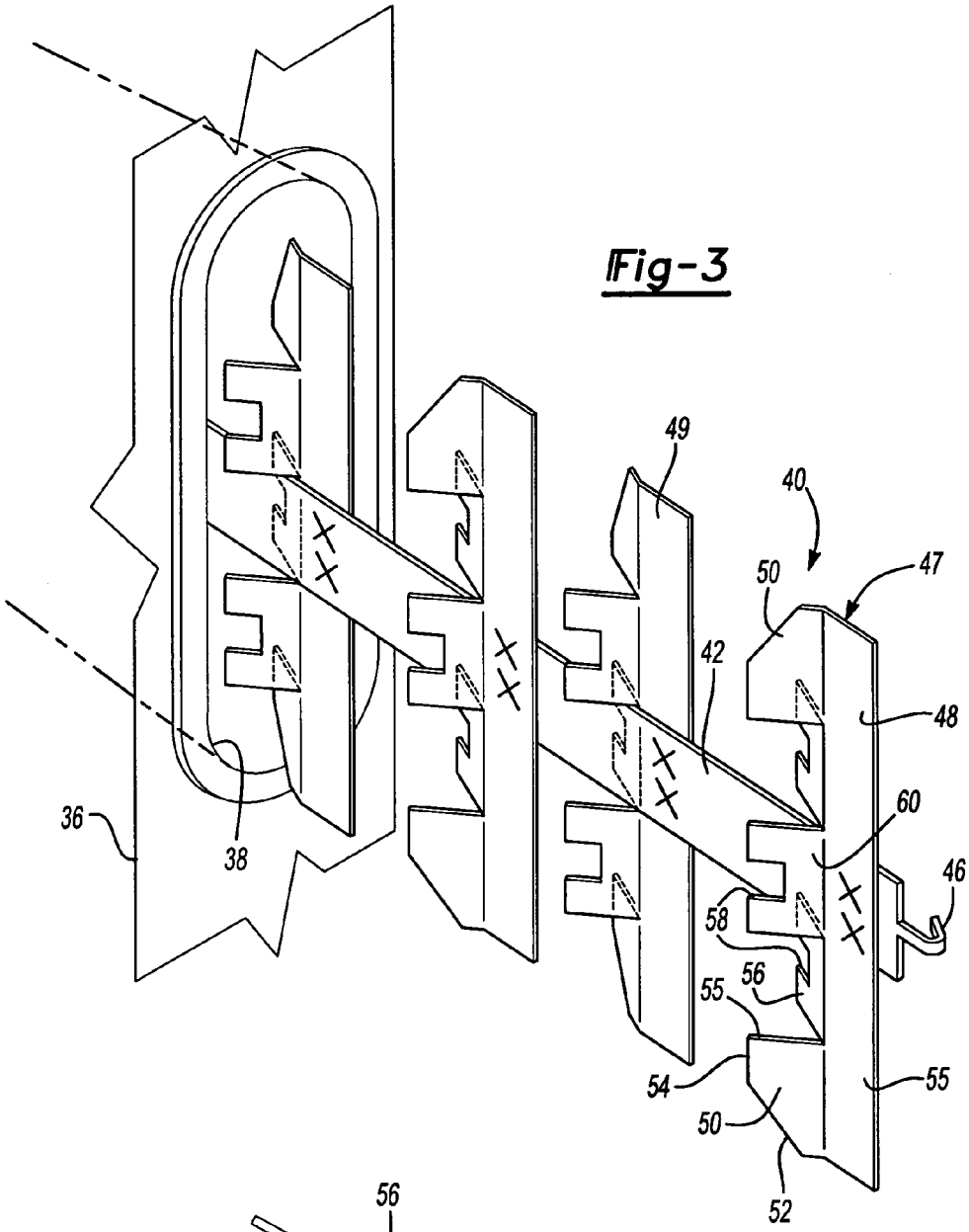
FIG. 3 shows a first embodiment turbulator for use in the FIG. 2A smoke tube.

FIG. 3 shows an inventive turbulator 40. Turbulator 40 includes a central connecting member 42. A hook 46 assists in securing the turbulator within the channel 38. A blade 47 includes a central web 48. The central web extends to the laterally outermost edges having a first flange 50 having an angled edge 52, and a top portion 54. An inner edge 55 forms the final shape of the flange 50. Further, flanges 56 extend from central web 55, and are non-rectangular. As shown, a rectangular cutout 58 is formed in the flanges 56. Yet a third flange 60 also has a rectangular cutout 58. The third flange 60 is generally aligned over the connecting member 42 when the blade 48 is welded to the connecting member 42. As can be appreciated in this figure, alternating blades 48 and 49 are positioned upon opposed sides of the connecting member 42 in this embodiment.

Figure 4:
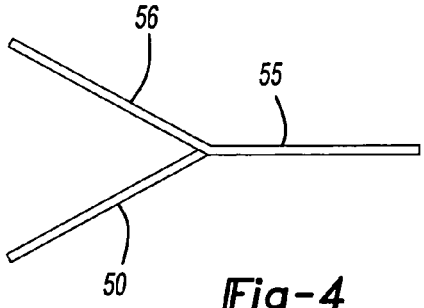
FIG. 4 is a side view of a blade in the FIG. 3 turbulator.

As shown in FIG. 4 (and also FIG. 3), the flanges 60, 56 and 50 all extend at a non-normal angle relative to the central web 55. The angle in one embodiment is between 30 and 45° relative to the plane of the central web.

Figure 5:
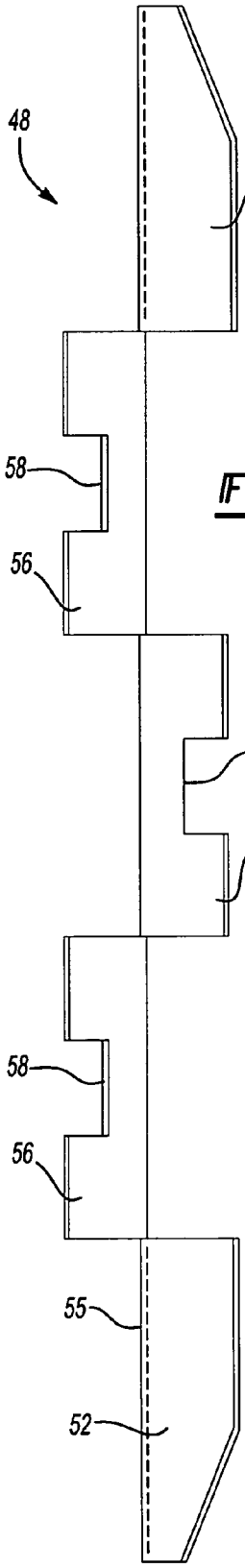
FIG. 5 is a top view of the FIG. 3 blade.

Further detail of the blade 48 can be appreciated from FIG. 5.

Figure 6:
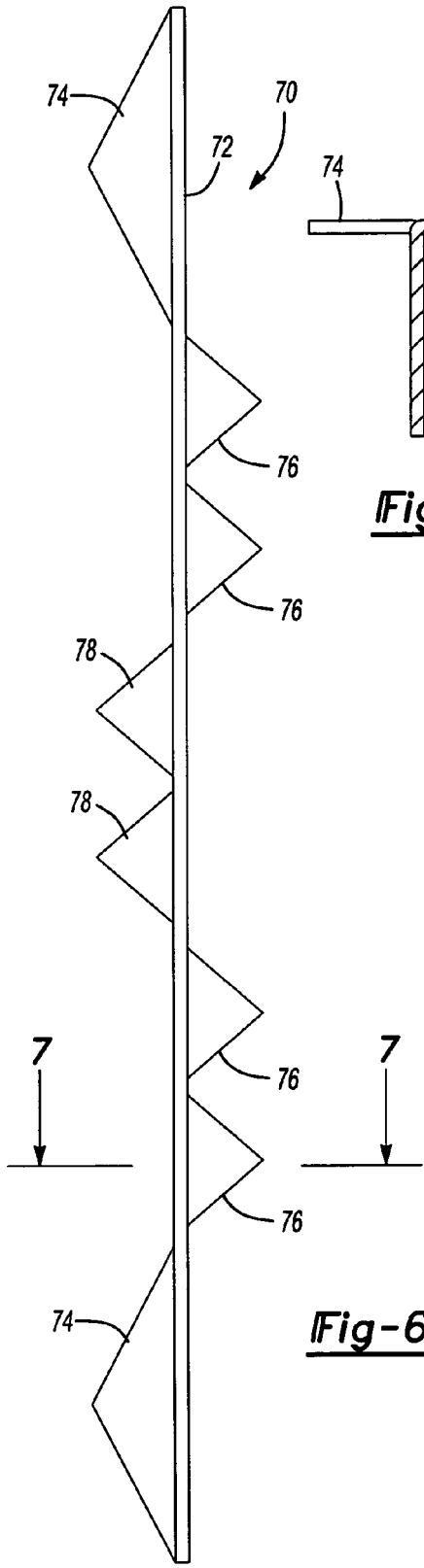
FIG. 6 shows a second embodiment blade.
Figure 7:
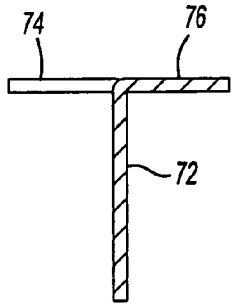
FIG. 7 is a side view of the FIG. 6 blade.

FIG. 6 shows another turbulator embodiment 70. Turbulator 70 has a central web 72, and outermost flanges 74. As can be appreciated, outermost flanges 74 are generally non-rectangular. The exact shape of the flanges 74, 76 and 78 are triangular, however, it should be appreciated that other non-rectangular shapes, and in particular those that have notches or cutaway portions at each lateral side of the flanges provide the benefit of reducing wake, and thus reducing pressure drop. Inner flanges 76 extend from the central web 72 in a direction opposed to the direction from which the flange 74 extends. As can be appreciated from this figure, the cross-sectional area of the flanges 76 is smaller than the cross-sectional area of flange 74, although there are preferably two of the flanges 76 on each lateral side. Central flanges 78 are also triangular and extend in the first direction from the central web. As shown in FIG. 7, central web 72 receives the flanges 74 and 76 at a normal orientation.

Figure 8:
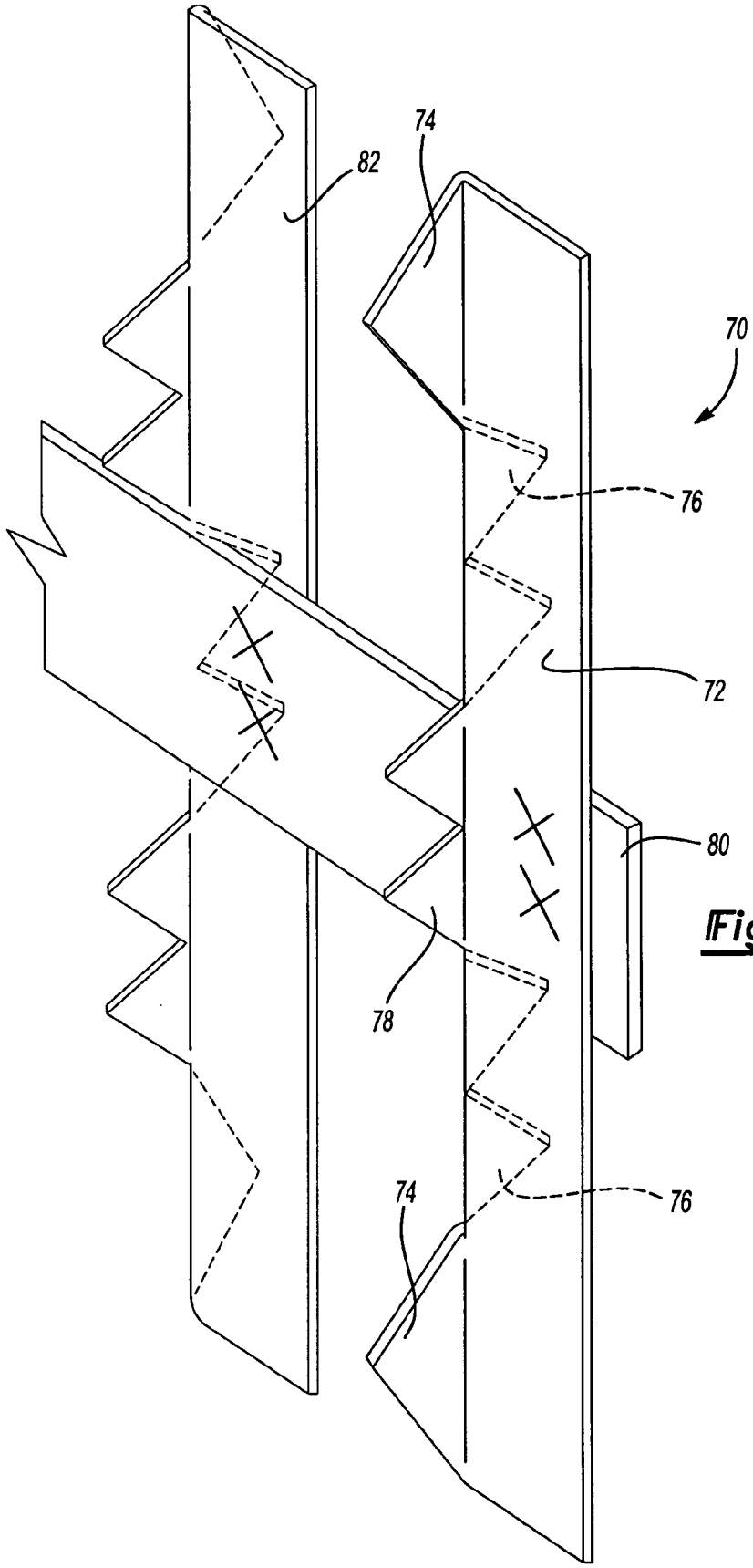
FIG. 8 is a view of the assembled second embodiment blade.

As shown in FIG. 8, the blades are attached to a central connecting member 80 in a manner similar to the first embodiment.

Figure 9:
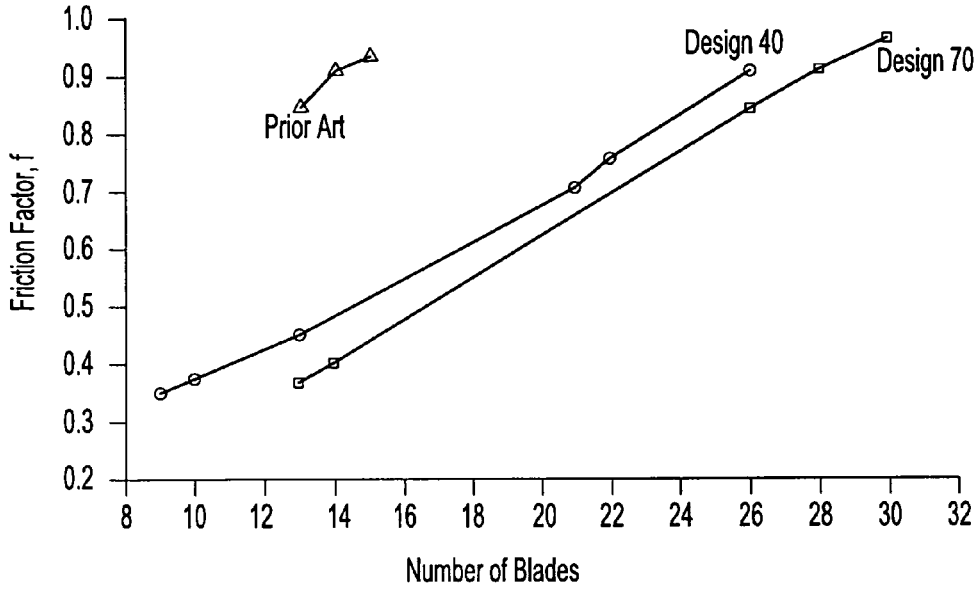
FIG. 9 shows a graph of a friction factor, and the number of blades for the prior art and the two inventive designs.

FIG. 9 graphically shows some results of the prior art (FIG. 2A), the first embodiment (FIG. 3), and the second embodiment (FIG. 8). As can be seen, the friction factor is greatly reduced in the inventive turbulators when compared to the prior art. This in turn results in a decrease in pressure drop.

Figure 10:
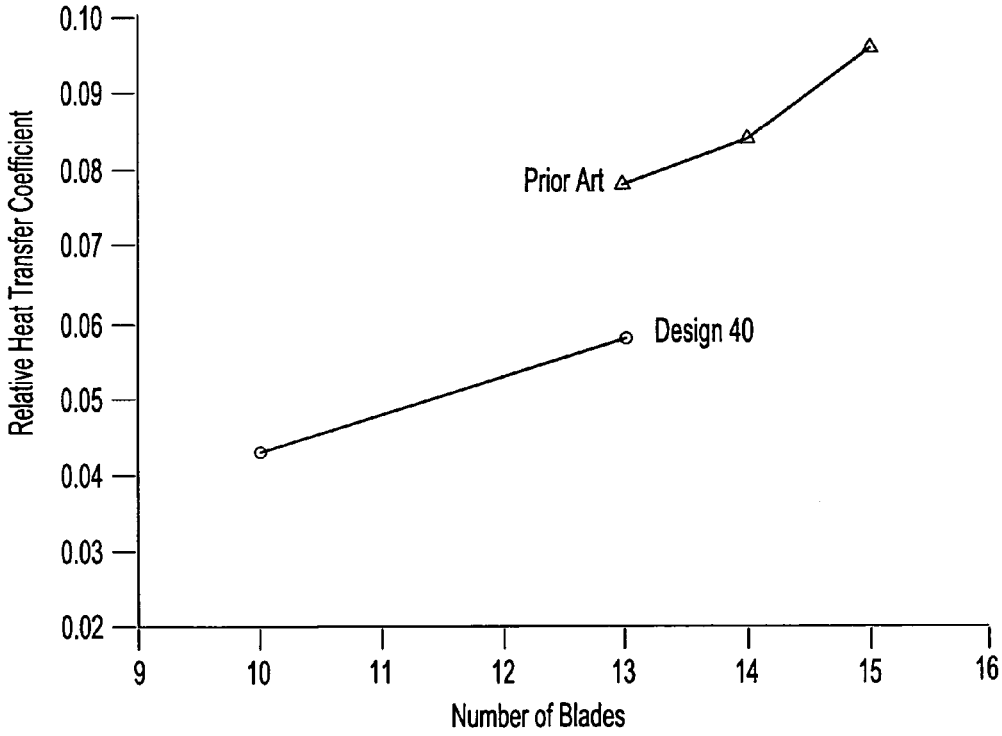
FIG. 10 shows the heat transfer coefficient plotted against the number of blades for the first embodiment and the prior art.

FIG. 10 shows that the prior art may well have the higher heat transfer coefficient than the first embodiment 40 (FIG. 3). However, due to the friction factor decrease as shown in FIG. 9, a greater number of blades can be utilized with the inventive design than was the case with the prior art. As such, adequate heat transfer can still be achieved.

Although triangular flanges are shown in FIG. 6, and rectangular cutouts from an otherwise rectangular shape in FIG. 5, other non-rectangular shapes may come within the scope of this invention.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An absorption solution/refrigerant system comprising:

a high-stage generator including a plurality of smoke tube channels receiving turbulators, said high stage generator being connected to receive a source of heated air, and said high stage generator also receiving an absorption fluid flowing around said smoke tube channels to be heated by said heated air in said smoke tube channel; and wherein at least some of said turbulators have an elongate connecting member secured to a number of blades, said blades including flanges extending from a central web, there being laterally outermost and laterally inner flanges, with at least some of said laterally inner flanges being non-rectangular in cross-sectional shape.

2. An absorption solution/refrigerant system as set forth in claim 1, wherein said laterally inner flanges extend in a first direction from said central web at a non-normal angle.

3. An absorption solution/refrigerant system as set forth in claim 2, wherein said laterally inner flanges have a nominal rectangular shape, with a cutout at an outermost edge spaced furthest from said central web.

4. An absorption solution/refrigerant system as set forth in claim 3, wherein said laterally inner flange elements include a pair of flange elements laterally spaced and extending in said first direction and an intermediate flange extending in a second direction from said central web, with said intermediate flange being positioned generally aligned over said connecting member, and said intermediate flange also being provided with a cutout portion.

5. An absorption solution/refrigerant system as set forth in claim 1, wherein said laterally inner flanges extending from said central web in a first direction, and said laterally outer flanges extending in a second direction from said central web.

6. An absorption solution/refrigerant system as set forth in claim 5, wherein said laterally inner flanges have a smaller cross-sectional area than said laterally outer flanges.

7. An absorption solution/refrigerant system as set forth in claim 6, wherein said laterally inner flange elements include a pair of flange elements laterally spaced and extending in said first direction and an intermediate flange extending from said central web in a second direction, and aligned to be over said connecting member.

8. An absorption solution/refrigerant system as set forth in claim 6, wherein said laterally inner flanges have a triangular cross-sectional shape.

9. An absorption solution/refrigerant system as set forth in claim 8, wherein said laterally outermost flanges also have a triangular cross-sectional shape.

10. An absorption solution/refrigerant system as set forth in claim 1, wherein said source of heated air is the exhaust of an engine.

11. An absorption solution/refrigerant system as set forth in claim 10, wherein said engine is a micro-turbine.

* * * * *